US007455225B1

(12) United States Patent
Hadfield et al.

(10) Patent No.: US 7,455,225 B1
(45) Date of Patent: Nov. 25, 2008

(54) METHOD AND SYSTEM FOR MONITORING AND CONTROLLING GOODS WHILE IN TRANSIT

(75) Inventors: Gary Hadfield, Clearfield, UT (US); David Clark, Clearfield, UT (US); Michael Mitchell, Clearfield, UT (US)

(73) Assignee: Sabioso, Inc., Clearfield, UT (US)

( * ) Notice: Subject to any disclaimer, the term of this patent is extended or adjusted under 35 U.S.C. 154(b) by 215 days.

(21) Appl. No.: 11/248,591

(22) Filed: Oct. 12, 2005

Related U.S. Application Data

(60) Provisional application No. 60/655,181, filed on Feb. 22, 2005, provisional application No. 60/655,136, filed on Feb. 22, 2005.

(51) Int. Cl.
*G07B 15/02* (2006.01)

(52) U.S. Cl. ..... 235/384; 235/385; 235/435; 235/444

(58) Field of Classification Search ..... 235/384, 235/385, 435, 444; 340/989
See application file for complete search history.

(56) References Cited

U.S. PATENT DOCUMENTS

| | | | | |
|---|---|---|---|---|
| 5,266,944 | A * | 11/1993 | Carroll et al. | 340/825.36 |
| 5,917,433 | A | 6/1999 | Keillor et al. | |
| 6,160,478 | A | 12/2000 | Jacobsen et al. | |
| 6,297,768 | B1 | 10/2001 | Allen, Jr. | |
| 6,476,763 | B2 | 11/2002 | Allen, Jr. | |
| 6,484,035 | B2 | 11/2002 | Allen, Jr. | |
| 6,710,738 | B2 | 3/2004 | Allen, Jr. | |
| 7,034,683 | B2 * | 4/2006 | Ghazarian | 340/568.1 |
| 7,149,658 | B2 * | 12/2006 | Kadaba | 702/184 |
| 2002/0042278 | A1 | 4/2002 | Crockett et al. | |

* cited by examiner

*Primary Examiner*—Seung H Lee
(74) *Attorney, Agent, or Firm*—Bateman IP Law Group

(57) ABSTRACT

A method and system for monitoring, managing, or transporting goods allows for monitoring the state of being of goods when in transit or unattached to wired power sources or communication means. The system also preferably includes the ability to adjust the conditions of the goods while they are in transit.

11 Claims, 7 Drawing Sheets

METHOD AND SYSTEM FOR MONITORING AND CONTROLLING GOODS WHILE IN TRANSIT

RELATED APPLICATIONS

The present application claims the benefit of U.S. Provisional Application Ser. No. 60/655,136, filed Feb. 22, 2005 which is hereby incorporated herein in its entirety and also claims the benefit of U.S. Provisional Application Ser. No. 60/655,181, filed Feb. 22, 2005 which is hereby incorporated herein in its entirety.

BACKGROUND OF THE INVENTION

1. The Field of the Invention

The present invention relates to a method of transporting, monitoring, and otherwise controlling goods and assets. More specifically, the present invention relates to a method of monitoring goods and assets (e.g. vehicles, vehicle contents, containers, container contents, people, high interest items, perishables, etc.) while in transit whereby the position and condition of the goods and assets can be monitored constantly or at desired intervals and whereby the condition of the goods and assets can be adjusted and controlled remotely.

2. State of the Art

Traditionally, goods undergo a series of steps in the process of manufacturing the goods, distributing the goods, and transporting them to a final destination, which might be a consumer, a retail store, or another manufacturing facility, for example. The steps through which goods typically pass along a typical distribution chain are often fixed, and are similar for many industries. These steps may typically include manufacturing, transportation to a storage facility or warehouse, storage in the warehouse, transportation to a distributor, storage at the distributor, and transportation to the end user. These steps are viewed as necessary by many industries.

There are, however, several limitations which are unavoidable with this typical type of supply chain. For example, a large amount of money is invested in inventory which is stored in a warehouse or other storage facility. Conventional wisdom suggests that a relatively large inventory is a good investment which provides income upon sale. This inventory represents a huge cost and only potential revenue. A significant drawback with a large inventory, however, is that many of the items held in inventory will become obsolete before they are sold. This is of greater concern where the goods are perishable, or where the goods are in an area of technology which is advancing rapidly. Additionally, large amounts of money are spent on the space necessary to store the inventory, support the personnel to manage that inventory, and overhead costs to maintain facilities and the assets. The infrastructure required to transport inventory to and from these facilities is also very costly. Money which is tied up in storing goods is money which could be diverted to goods which are actively sold, or to developing new goods or technology.

Similarly, a distribution facility creates many of the same type of drawbacks that a warehouse full of inventory creates, requiring storage of a quantity of goods, additional transportation, and management.

This traditional view of a supply chain also results in additional delays and costs because of the need to stop the flow of goods to obtain information about the goods, such as quantity or the condition of the goods, or because the supply chain itself creates the need for additional information gathering, processing, and utilization, such as where stored inventory must often be checked for quantity and quality and the storage conditions changed to ensure the quality of the goods. This traditional view, in turn, requires higher levels of inventory because of the delays and lock of knowledge surrounding the supply chain and the goods themselves.

A significant number of man hours are required to monitor the goods stored in a warehouse. Personnel must be available to receive goods and place them into the warehouse in an ordered manner, to inventory the goods periodically, to check the goods for quality and adjust the storage conditions, and to organize the goods for shipment and evacuate them from the warehouse. The man hours, in combination with the cost of the warehouse space itself and the cost of utilities for operating the warehouse create a significant expense for the company.

Additionally, in a traditional supply chain or its sub-set distribution network, the company is unable to remedy problems as they arise, leading to additional delays. For example, if goods are damaged during shipping, the problem is not known until the goods arrive at the final destination. Once the problem is known, it is very difficult to determine when or where the damage occurred. Additionally, many problems are difficult to detect and may not be known until the goods are on a store shelf for sale or until a subsequent manufacturer uses the goods. At this point, additional damage or costs are incurred as compared to where the damage to the goods is more promptly ascertained.

Where goods are damaged or stolen in transit, there are typically significant delays in replacing the goods. Once the damage or loss is ascertained, usually after shipping, a new item must be sent from the manufacturer or distributor, typically taking as long or longer than the initial shipping process. The delay in obtaining replacement goods causes additional hardship for the recipient of the goods.

In many situations it is desirable to monitor various types of goods. It is important to maintain accurate information about the quantity and quality of goods in various stages of business such as production, storage, transportation, and sales.

It is of great importance to maintain accurate information and control over goods which are in transit. It is necessary for nearly all industries to ship goods using various carriers such as semi-trailers, trains, ships, and airplanes. Companies can maintain accurate control over the conditions of goods in their facility, but frequently can not control the conditions or security in which the goods are shipped.

Many goods are perishable or otherwise susceptible to damage in shipping. Fruit, for example, should be maintained under relatively strict temperature control during transit. It is possible to maintain such control during transit, but this is heavily dependent on the person in charge of transit. Typically, fruit will be shipped by truck. Thus, the truck driver is primarily responsible for the fruit during transit.

As an example, fruit should often be maintained below a certain temperature during transit, with a limited amount of time above that temperature being acceptable. Suppose fruit could be above the desired temperature for 1 hour during transit without increasing the risk of spoiling the fruit. During transit, the driver would often be required to stop and check the temperature of the fruit every hour and create a log of the temperatures to show that the fruit was not damaged during transit. This adds significant time and cost to the transportation of the fruit. Additionally, the company must rely on the driver's honesty in accurately controlling and logging the temperature of the fruit.

An additional limitation in maintaining the temperature of the fruit during transit is that the driver may often stop for a nap during transit. Because the refrigeration unit on the trailer is often noisy, it is not uncommon for the driver to turn off the refrigeration unit while sleeping. If the driver sleeps for several hours, the fruit is more likely to spoil, but this will not typically be discovered until the fruit is on the store shelf.

It is thus desirable to maintain accurate information about the goods in transit. It is desirable to accurately monitor the quantity, location, and physical attributes of the goods such as temperature, chemical state, consistency, quality, operational status, amount, security, etc. It is equally advantageous to then be able to adjust the physical conditions of the goods in transit, such as adjusting the temperature, chemical state, consistency, quality, operational status, etc. of the goods, and to ensure the quantity and security of the shipment.

Additionally, it is desirable to know where the specific goods are while in transit, and to verify the number of goods which are being shipped. This allows a company to know about and plan for delays in shipment, as well as account for loss during shipment.

Currently, it is difficult and time consuming to monitor various types of goods. Typically, to count or check the condition of goods, an employee must manually perform the task. This is time consuming and inconvenient, resulting in additional operating expenses for the business. A significant limitation is where current methods of monitoring goods require that the goods be stopped for physical inspection. This is true in nearly all areas of business discussed. A shipper must typically delay, slow down, or stop a shipment to inventory the goods or check on the quality or physical conditions of the goods. A warehouse or manufacturing facility must stop goods, or at best, route them through specific checkpoints, significantly slowing down the supply chain, as they enter or exit different parts of the facility or the facility itself to verify and record the quantity and quality of goods.

Thus, currently available methods of monitoring goods do not readily allow a person to constantly monitor the location, quantity, state of being, and quality of goods. This information may only be known by stopping or at best delaying the goods or operations and requiring an employee to check on the goods and record the desired information. This results in a significant cost in monitoring the goods, and significantly limits where and when an individual can monitor the goods.

Additionally, current methodologies of supply chains and goods distribution create significant costs and time delays There is thus a need for a method and system for transporting, managing the transportation of, monitoring, and controlling goods which eliminates the significant time delays and additional expenses involved with storing inventory and shipping goods, and which eliminates or reduces the lack of ability to monitor and manage the goods. Additionally, there is a need for a method of transporting goods which allows an individual to access current information regarding the location, quantity, and physical conditions of the goods without requiring a person to stop the movement of the goods and obtain this information, and without requiring that the goods be stopped or otherwise interrupted from the course of manufacturing, storage, shipping, selling, or the like.

Similarly, there is a need for a method and system for monitoring desired conditions or attributes of a variety of items, including but not limited to goods, inventory, shipments, equipment, or even personnel.

SUMMARY OF THE INVENTION

It is an object of the present invention to provide an improved method and system for tracking, monitoring, and managing goods and assets while in transit.

One aspect of the present invention is a method and system of monitoring goods which is inexpensive and easy to operate.

Another aspect of the present invention is a method and system which is capable of determining the quantity and location of goods which are undergoing in transit production, storage, in use, moving, or being shipped, and in monitoring the state of being of these goods.

Another aspect of the present invention is a method and system which automatically determines the state of being, location, and/or quantity of goods without requiring an individual to stop movement of the goods or assets in order to take a physical inventory of the goods.

Yet another aspect of the present invention is a method for monitoring and adjusting the condition of goods which are in transit or being shipped. Additionally, an aspect of the present invention is a monitoring device which is capable of monitoring the physical conditions of goods in transit, and which is capable of sending such information to a remote computer system (work station, wireless PDA, Tablet PC, Cell Phone, etc.) responsible for maintaining information regarding the goods and for providing access to such information. Additionally, an aspect of the present invention is providing a method of shipping and monitoring goods where a person may remotely alter the conditions of goods which are in transit.

Another aspect of the present invention is a method of monitoring the quantity and location of goods in shipment to determine if goods are delivered properly, or if theft has occurred.

Another aspect of the present invention is a method and system which is capable of measuring physical conditions of goods is transit, and which allows an individual to determine if damage has occurred or if the physical conditions of the goods have been maintained within acceptable limits during transit.

Another aspect of the present invention is a method and system his capable of remote two-way contact and control of goods and assets by other means such as a computer work station with internet connectivity, and wireless devices including cell phones and pagers, key fobs, and PDAs.

The above aspects are intended to be illustrative of the present invention, and are not limitations of the scope of the appended claims.

BRIEF DESCRIPTION OF THE DRAWINGS

Various features and advantages of the present invention will become apparent as embodiments of the invention are shown and described in reference to the numbered drawings in which.

Figure 1:
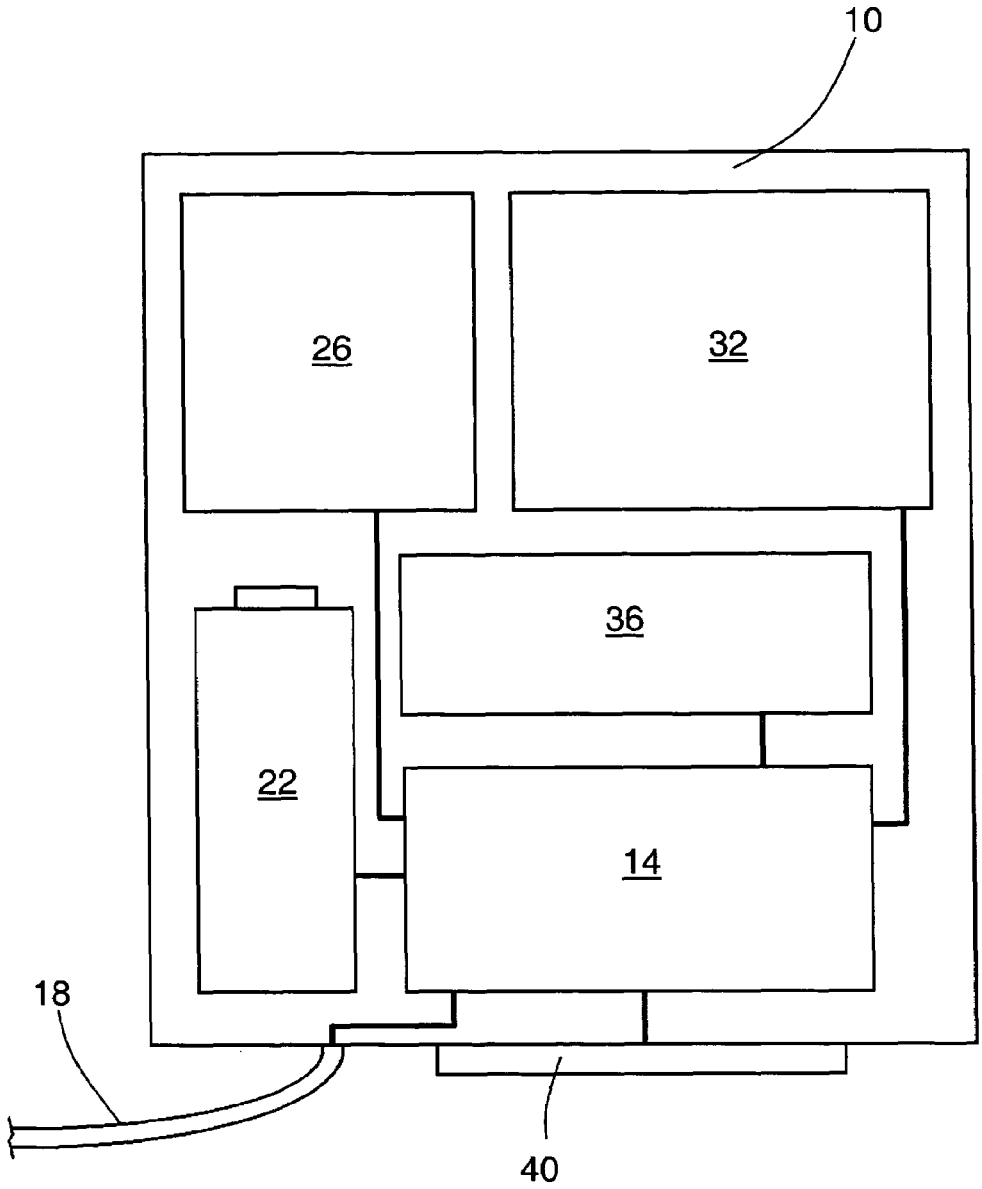
FIG. 1 shows a schematic diagram of a monitoring and control device.

It will be appreciated that the drawing are examples of aspects of the present invention and do not limit the scope of the invention, which is defined by the appended claims. Many small modifications may be made which are within the scope of the claims.

DETAILED DESCRIPTION

The drawings will now be discussed in reference to the numerals provided therein so as to enable one skilled in the art to practice the present invention. The drawings and descriptions are exemplary of various aspects of the invention and are not intended to narrow the scope of the appended claims.

The present invention finds use in monitoring items of many types during transit. In discussing the present invention, the shipment or movement of certain items will be discussed in reference to the mode of shipping which is most common for that item. It will be appreciated that the various aspects of then present invention apply equally to most forms of shipping or transit, and the invention as discussed may be applied to many modes of shipping and different situations.

Turning now to FIG. 1, a schematic diagram of a monitoring and control device according to the present invention is shown. The monitoring and control device 10 is typically constructed so as to be as compact as possible, allowing it to be placed in a maximum number of possible locations and environments and increasing the usefulness of the device. According to one aspect of the invention, the monitoring and control device may be customized according to the demands of the desired application, and many configurations are thus possible. FIG. 1 shows a monitoring and control device which has components typical of many different applications.

The monitoring and control device 10 will typically contain at least one processor 14. The processor 14 is primarily responsible for manipulating and transmitting signals between the various other components of the device 10, and commanding communications and control of remote devices wirelessly.

The monitoring and control device 10 is typically provided with an electrical input 18 which supplies power to the processor 14 and thereby to the entire device. Additionally, the device 10 will also typically contain a battery 22, and when required, solar panels or other energy sources in support of continual battery power. The battery 22 may also provide back up power in the event that the power from the electrical input 18 is interrupted. With the low power consumption of modern electronics and the high power storage of modern batteries, it is possible to configure the battery 22 such that it may provide power to the monitoring and control device 10 for an extended period of time. The processor 14 may also contain a circuit which charges the battery 22 when the input 18 provides power, and which draws power from the battery 22 when the input 18 is not providing power.

The monitoring and control device also contains either a transmitter and receiver, or a transceiver 26. The transceiver is capable of sending out various types of signals, both to send and receive information from a separate control facility, and to send and receive information from identification tags, wireless sensors, or the like. The device 10 may also contain a GPS unit 32. GPS devices 32 communicate with satellites to determine the location of the GPS device on the earth. The GPS 32 can provide this information to the processor 14, so that it can be sent to a separate control facility via the transceiver 26. Location can also be ascertained through other geo-reference devices such as the micro, self-meshing ALF (Automatic Location Finder) or Znode devices.

The monitoring and control device 10 may also contain a variety of onboard sensors 36. The sensors are typically chosen for each specific application, but may include temperature sensors, movement or acceleration sensors, light sensors, etc. Any type of sensor which is necessary for a specific application may be utilized in combination with the device 10. Additionally, the monitoring and control device 10 may have an output connection 40, whereby additional sensors, cameras, output control devices, or the like may be connected. It is often the case that equipment external to the device 10 is needed, such as a remote temperature probe, a camera to monitor cargo or to monitor a door, or an output control capable of adjusting a monitored parameter, locking a door, etc.

Figure 2:
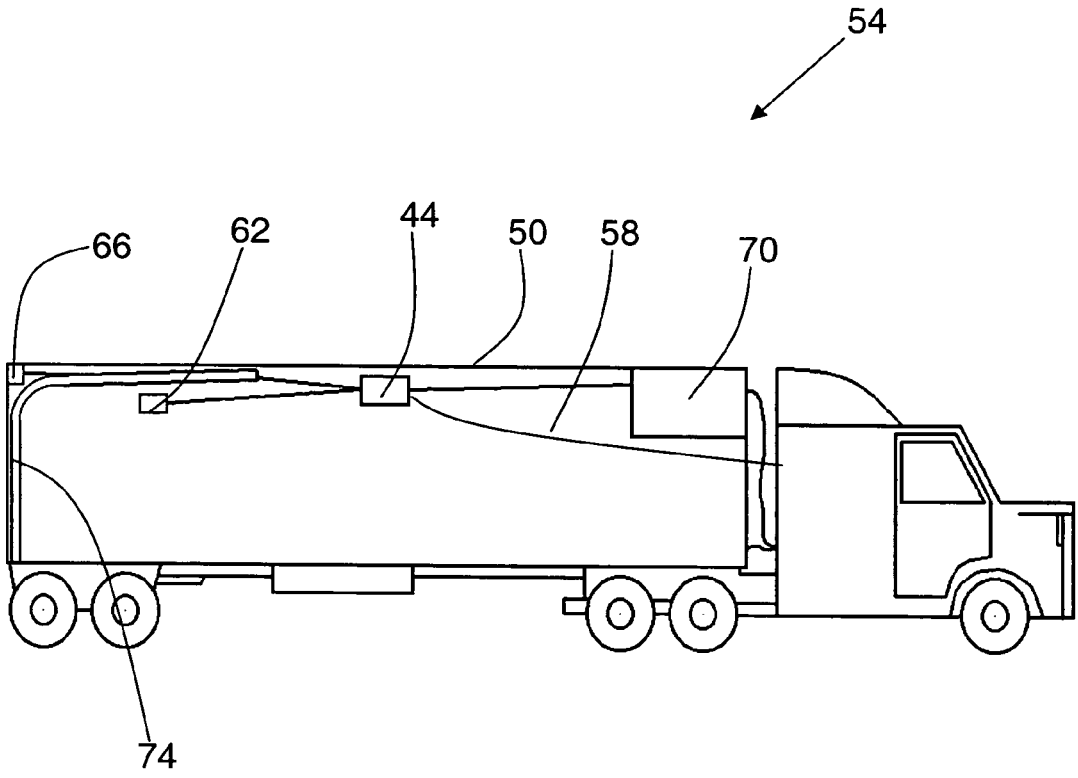
FIG. 2 shows a truck and trailer with a monitoring and control device.

Turning now to FIG. 2, a truck and trailer with a monitoring and control device according to aspects of the present invention is shown. A monitoring and control device 44 may be mounted in the trailer 50 of a semi-truck, indicated generally at 54. The monitoring and control device 44 may be configured to perform a variety of functions, such as regulating temperature, monitoring the doors and cargo, or monitoring the truck itself.

The monitoring and control device 44 may be connected to the truck for power 58, or battery, or small solar panels, to external devices 62 and 66, and to external equipment such as a refrigeration unit 70. The devices 62, 66 may be any devices which are necessary for the desired operation of the monitoring and control device 44.

Accordingly, the monitoring and control device 44 may measure temperature and adjust the refrigeration unit 70 including switching the unit on or off and overriding the manual settings. Additionally, the monitoring and control device may monitor and control the door 74 by using a movement sensor and or electronic lock 66. The device 44 may also be connected to a camera 62 to monitor the door and or goods.

According to one aspect of the present invention, the present invention may be used in the transportation of sensitive goods such as fruit, frozen foods, etc. By way of example, it is common for fruit and certain chemicals and raw materials to be shipped over large distances by truck, or rail, such as in shipping fruit from California or other states or even other countries such as Mexico, Central America, and the Caribbean to various locations for sale, manufacturing, and consumption. In these situations, the fruit, or chemicals must be refrigerated, or heated during transit to maintain the quality and freshness of the fruit or to maintain the safe and proper state of being of the chemicals.

More specifically, the fruit, or chemicals must often be maintained below, or above a target temperature, with only a small period of time being acceptable during which the fruit or chemicals are above the target temperature, such as an hour. This requires that the driver is diligent in operating the refrigeration or heating units on the trailer. Additionally, the company may require that the driver log the cargo temperature during shipment to evidence that the fruit or chemicals were properly maintained during transit. The company thus depends on the competence and honesty of the driver in both maintaining the proper cargo temperature and in recording the temperature during shipment.

Commonly, drivers may fail to accurately record the temperature, or may even falsify the temperature readings in order to escape punishment for the damage to the fruit. Additionally, the driver may fail to properly adjust or operate the refrigerator or heating units during the trip, or may disconnect the refrigeration unit to reduce the noise that it generates while the driver is taking a nap, compromising the quality of the fruit or chemicals being shipped. The driver may then falsify the logs to cover the failure to properly refrigerate or heat the fruit or chemicals. At this point the damage to the fruit or chemicals may not be known for a few days, when the fruit or chemicals is already at a store or production facility for sale or purchased by a consumer. Additionally, it is now difficult to ascertain the source of the damage to the fruit, since there is no proof of when exactly the damage occurred.

The present invention can eliminate the above described problems through the use of a remote monitoring and control device. A remote monitoring and control device will typically consist of sensors and/or cameras, control output devices, a power source, a central processor, and a communications unit. In accordance with the needs of shipping fruit or chemicals according to this example, the remote monitoring and control device will be outfitted with a temperature sensor which monitors the temperature of the fruit or chemicals, a control device which is capable of either mechanically or electronically adjusting the operation of the refrigeration unit, a processing unit, and a communications device.

The communications device is capable of communicating with computers or other wireless devices located anywhere, but often located at a centralized control facility. Accordingly, the communications device is capable of sending information to and receiving commands from the control facility. This allows a person at the control facility to control the temperature set point of the refrigeration unit, for example. It is also possible to program a computer to send a signal, such as the temperature set point if necessary, without the intervention of an individual.

The output control devices are optimally connected electronically with the refrigeration control unit, and provide a channel of communication whereby the processing unit of the remote monitoring and control device can determine if the refrigeration unit is on or off, what temperature the unit is set at, or even whether the refrigeration unit is functioning properly. Through this connection the remote monitoring and control device may also be able to determine the temperature of the fruit, but if this is not possible, a separate temperature sensor may be installed which connects to the remote monitoring and control device.

A battery is typically provided which is sufficient to operate the remote monitoring and control device for a desired period of time, such as a year, a month or a number of days as is desired. Typically, the remote monitoring and control device will operate off of the electrical power which is provided by a device battery, solar panels, or the semi-truck to the refrigeration unit, and the battery supply will continue to power the remote monitoring and control device in the event that power from the truck is lost. The power can also be remotely controlled (turned on and off) from a computer connected to the internet and any number of wireless devices.

Through the remote monitoring and control device, the temperature of the fruit may be monitored and recorded automatically throughout the trip. Additionally, the remote device is able to sense if the refrigeration unit malfunctions or is switched off during the trip. Through the output control devices, the remote monitoring and control device preferably is able to switch on a refrigeration unit which was improperly switched off, and can adjust and control the temperature of the fruit. Thus, a company may change the shipping conditions while the goods are in transit to optimize the conditions to the requirements of the individual goods.

Thus, the company has access to a record of the desired events during transit. The company will have access to an accurate report of the temperature of the fruit during transit which can not be falsified, and will accurately know if any undesired event occurred, such as the fruit being at too high of a temperature. The company may also determine if the driver contributed to or caused a problem, by turning off the refrigeration unit, for example.

Similarly, frozen foods must be maintained below a target temperature during shipment. If the food temperature is too high during shipment, the food spoils. It is often difficult to detect the spoilage before a customer has prepared and is eating the food. The system may thus prevent the food from reaching too high of a temperature, and provide a record that the food has been properly shipped. At a minimum, the system will prevent food that has likely spoiled from being sold to consumers, thereby preventing the loss of goodwill.

In addition to providing a record of the desired shipping conditions, the company may be immediately notified if a problematic situation has arisen, allowing the company to take immediate action. Thus, new goods can immediately be sent to replace goods damaged in shipment. This provides for quicker replacement of the goods, and improves the good will of the company because the company is discovering and correcting problems instead of requiring the customer to discover the defective goods.

Additionally, a GPS unit may be integrated, if desired, into the remote monitoring and control device which can provide the location of the fruit during shipment, thus providing information regarding where incidents occurred during shipping. The monitoring device can then provide information such as the timeliness of the shipping, including whether the driver took any unauthorized detours or unnecessary delays in making the shipment.

A remote monitoring and control device provides several advantages to a company. It allows the company to prevent unnecessary spoilage of the fruit by directly controlling the temperature of the fruit and not allowing a driver to improperly operate the refrigeration unit. It also allows the company to track the shipment and determine when or where undesired events happened during transit. The device also provides the company with reliable information which can not be fabricated by a driver and which shows that the goods were not spoiled during shipment. In the event that the fruit is damaged, the monitoring device provides information regarding who, if anyone is at fault, allowing the company to determine if a truck or refrigeration unit is defective, or if a driver is responsible for the damage.

Importantly, the monitoring and control device provides immediate notification of conditions which are likely to damage the goods, allowing the company to take immediate action in replacing the goods instead of allowing the customer to discover the defective goods upon arrival and attempting subsequent remediation of the damaged goods.

This type of method and system for monitoring fruit may also be used for shipping other perishable goods, such as foods, chemicals, or the like. Any desired parameter (state of being) such as temperature, pressure, or even exposure to light may be measured during shipment as is necessary to ensure that the goods were not damaged during shipment. By way of example, the temperature of epoxy or other chemicals may be measured and controlled to ensure the quality of the chemical. Additionally, the pressure inside of a tank may be monitored and controlled to ensure the safety of the shipment and quality of the goods.

A variety of additional parameters may be measured in the shipping of goods to both improve the quality of the shipped good as well as reduce the costs associated with shipping the goods. For example, the engine status may be monitored with a monitoring and control device. It may be reported when an engine is switched on or off, or the engine status may be continually reported. Remote control of the engine status may also be provided by connecting the monitoring and control device to the starting circuit of then engine. This allows an individual to remotely switch the engine on or off. In addition to monitoring the status of the engine, the monitoring device provides the necessary information to track the cumulative run time of the engine, and track the time periods when the engine is on or off.

The ability to monitor the engine operation enables a company to determine if a shipment is being delivered according to schedule. Additionally, the company may schedule maintenance, such as oil changes, based on actual engine run time information as opposed to the less accurate gauge of mileage.

Additionally, the ability to remotely control the engine status may be combined with the ability to remotely control the refrigeration unit to allow a company to remotely prepare a truck for a trip. The truck engine and refrigeration unit may be started a desired amount of time before loading to cool the trailer to a desired temperature, preventing damage to sensitive goods without the additional man hours required for a person to prepare the truck for shipping by hand.

The ability to control and monitor the engine may also be advantageously combined with other functions of the monitoring and control device. For example, the engine run time reporting may be combined with vehicle tracking (which may be provided by integrating a GPS unit into the monitoring and control device) to determine if the vehicle is being run excessively when not traveling along the desired route.

Additionally, a GPS unit functioning in combination with a monitoring and control device provides real-time location information regarding the shipment. Real-time information regarding the location of a shipment allows a company to provide better shipping service because the knowledge of the shipment allows the company to solve shipping problems, such as traffic problems, detours, etc. by redirecting the shipment around the problem and by planning for delays. Additionally, where a company provides order tracking to customers, the GPS capability allows the company to provide accurate and up to date information regarding the location and status of the shipment to the customer, where typical order tracking often provides information which is days out of date. GPS also provides the capability to monitor the crossing of state and national borders. This information is critical for security reasons for many companies. Also, using GPS information in combination with time, mileage, and fuel levels, information may easily be provided to the Department of Transportation to meet regulations for road tax costs.

The fuel level and fuel consumption of the truck may also be monitored by connecting the monitoring and control device such that it receives a signal from the fuel level sensor installed in the fuel tank of the truck. Monitoring the fuel level allows the company to detect problems such as sudden loss of fuel, fuel leakage, or purchasing more fuel than necessary to fill the tank, which might indicate theft. A company would also be able to monitor the fuel level and consumption and combine this information with the mileage driven to track the fuel economy of the truck. This would allow a company to determine when a tune up or other repairs are necessary by tracking the decline in fuel economy of the vehicle. With the increasing costs of fuel, even modest improvements in fuel economy can add significantly to profits.

According to another aspect of the present invention, significant advantages in safety and security of a shipment may be provided by utilizing a monitoring and control device. The monitoring and control device may be configured with remotely operable door locks, door sensors, cameras, etc.

For example, a truck or shipping container may be provided with remotely operable door locks and a monitoring and control device which controls the locks. Accordingly, the locks may be configured to be opened only by an individual in a control facility or at the company's offices. Accordingly, a shipping container may be provided where individuals along the shipping route do not have access to unlocking the container. The container may also be constructed such that the doors may only be unlocked electronically from a control facility.

The monitoring and control device may also be configured with sensors to monitor for tampering with the doors, locks, or monitoring device. The monitoring device may thus be configured to send signals to the control facility to record incidences of possible tampering with the shipping container.

The monitoring and control device may also be configured with one or more cameras mounted inside of the shipping container. The cameras may be configured to accomplish a variety of purposes. For example, the cameras may be set to take pictures of a door area whenever the door is opened to capture pictures of any individual tampering with the container. The cameras may also be set to record video of the doors whenever the doors are open.

The cameras may also be used to control the inventory of the container. It is possible to record images of the contents of the container, and even to determine the amount of the container which is filled by goods. The cameras can be sensitive to visible light and to infrared light and accordingly can take pictures in darkness. The cameras may thus detect movement or otherwise monitor the contents inside of the sealed container, and take pictures or video of an individual opening the doors of the container at night.

Security may thus be enhanced by both making the doors and locks more secure, but also by monitoring any tampering of the doors or locks and recording pictures or video of any individuals who open the doors.

In addition to making the shipment more secure, the addition of remotely controlled locks, monitoring sensors, and the like provide additional benefits such as easing customs and security clearance, and in creating a mini-bonded warehouse. Where a company can ensure the packing conditions of a container, and verify that the container was not tampered with during transit, the company will be able to clear customs and security much more easily.

Additionally, where goods are stored, whether temporarily in a trailer or in a storage facility, a monitoring and control device according to the present invention may greatly increase the storage security. The monitoring and control device may remotely lock and doors, preventing access without a signal being sent from a control facility. The monitoring and control device may record attempts to tamper with the doors or storage facility and record video and or pictures of individuals who are tampering with or have broken into the storage.

The ability to monitor the cargo status of a trailer also allows a company to determine if a trailer is in "detention" or not. "Detention" refers to a situation where a company receives goods on a truck trailer, and is required to empty the container by a certain time, such as within two hours or before the end of the business day, but does not unload the trailer on time and uses the trailer to continue storing the goods. The receiving company is required to pay for the use of the trailer, either by an hourly or daily rate, but it is often difficult to determine and/or document when a trailer is in "detention". To determine if a trailer is in "detention" and determine for how long a trailer is in "detention" the truck driver must typically wait with the trailer while it is unloaded, or at the least wait for the trailer at the time specified to have the trailer unloaded and record for how long the trailer remains loaded. Many drivers prefer to simply go home or go out to eat dinner and do not record the amount of time a trailer may be in "detention."

With the present invention, a company may monitor whether and for how long a trailer is in "detention" by simply taking pictures of the inside of the trailer to determine if goods remain on the trailer. The cameras of the monitoring and control device may be instructed, either automatically or manually from the control facility, to take pictures of the inside of the trailer at the beginning of every hour to determine if goods remain on the trailer and the trailer is in "detention." Alternatively, a final closure of the door may be recorded to show when all goods have been removed.

The fees charged for not promptly unloading a trailer are significant, and are typically not well collected because the shipping company can not easily determine if the trailer is unloaded or not. Furthermore, the company often must rely on the word of the driver versus the word of the dock hands in showing that a trailer was in detention. The present invention provides a simple way in which the company may determine if the trailer was unloaded on time or not. Additionally, the information can be recorded to document the detention charge.

The monitoring and control device may monitor the contents of the trailer without light (such as with an infra red camera or a camera with a flash), and can thus easily validate whether the trailer is empty or not. Additionally, the monitoring and control device can record when the trailer is completely emptied and automatically record the emptying of the trailer. The monitoring and control device may thus be used to automatically prepare a detention report of the trailer and allow the company to bill the customers for the detention.

According to another aspect of the present invention, a monitoring and control device may be used to provide a portable inventory control system. The monitoring and control device may be configured with a sending and receiving unit which functions with tags placed on the goods being transported to inventory and track the goods. The present application will be discussed in reference to RFID (radio frequency identification) tags, Znode tags, or ALF (Automatic Location Finders-smart RFID), but it will be appreciated that many different systems of transceivers and identification tags are available which would function equally well.

For a system of RFID, Znode, or ALF tags, the monitoring and control device would typically be outfitted with a radio frequency transmitter and receiver, or a transceiver module. The goods would be fitted with individual RFID, Znode, or ALF tags. Each tag may be encoded such that when the transmitter sends out a radio signal, each tag sends back a different signal which is detected by the receiver and which identifies each individual tag. Accordingly, the inventory of the goods provided may be as detailed as a company desires, and by placing RFID, Znode, or ALF tags on each item in the shipment the company may track each item individually, or may simply keep track of the number of any particular type of item. The RFID, Znode, or ALF tags are inexpensive, so a company is able to track each item if this is desired.

The monitoring and control device is able to communicate with a control facility, and thus can report all changes in inventory to the control facility. With the inventory system as discussed, the monitoring and control device is able to sense when a tagged item enters and exits the shipping container. The system may then report and record when an item is picked up and when an item is dropped off. Additionally, if a GPS system is added to the monitoring and control device, the system will be able to report where an item was picked up or dropped off to the control facility.

A company is thus able to maintain complete and real-time management of their goods as they are being shipped. This is especially advantageous in controlling theft. Typically, a company does know when or where along a shipment route that an item was stolen. With the present inventory system, a company can know exactly when and where an item was removed, and the company may be notified of the loss immediately if it happens at a location where the goods should not be leaving the container. This may allow the company to determine who is responsible for the loss.

For example, if a customer reports that a delivery was missing some goods, and the inventory reports show that all of the goods were taken off the truck simultaneously at the time of delivery, it may be shown that the customer (or its employees) is responsible for the loss, as the goods were likely stolen from the receiving dock. If the record shows that the goods were never loaded onto the truck, the shipping company is responsible for the loss. If the record shows that the goods were lost in transit, the driver may be responsible. The record may show that the goods were removed near the driver's home, or that the driver was off the intended delivery route when the loss occurred, indicating that the driver was likely at fault.

The present invention is thus useful in determining when and where theft or loss occurs, and in determining if a particular party is responsible for the loss.

According to another aspect, the present invention may be used to monitor for conditions which are damaging to the product or which are potentially hazardous. A monitoring and control device may be utilized in a shipment in connection with a variety of different sensors to monitor any condition which may be damaging to the goods in shipment or which may present a hazardous situation. Many goods are sensitive to various conditions, such as elevated temperatures, exposure to oxygen, or exposure to various forms of light including visible, ultraviolet light, or infrared light. The presence of these conditions can damage or destroy a good rendering it valueless. Even worse, exposure to these conditions may create a hazardous condition as chemical reactions in the goods may produce heat, explosions, or the like.

Additionally, sensors may be utilized which sense the emissions which would be present if the goods being shipped were to become unstable or unsafe for shipment. The monitoring and control device might also include sensors which are configured for detecting leakage of the goods being shipped, whether by detecting the good itself, or by detecting emissions caused by the leaking goods. The emissions caused by leaking or unsafe goods might include excess heat, light, gasses, chemical or biological emissions, etc.

The sensors used may be selected according to the specific goods being shipped. For example, if a chemical is shipped which is sensitive to light exposure, a light sensor may be used to monitor for light being allowed into the shipment container. The presence of light would be detected by the sensor and the information sent to a control facility by the monitoring and control device. Similarly, if a product were sensitive to the presence of oxygen, an oxygen sensor would be placed in the shipping container. Detection of oxygen could thus be immediately reported to a control facility and or to a person responsible for a shipment as is necessary to properly manage the shipment and avoid potentially dangerous conditions. Where dangerous shipping conditions could develop during shipment, early detection of undesirable conditions is critical to preventing or minimizing damage. For example, chemicals which may have been compromised could be rerouted away from highly populated areas.

Similarly, sensors could be used to detect dangerous conditions by the emissions which would be present should a problem arise. Some products, give off heat if the products degrades or undergoes a chemical reaction. A temperature sensor could be installed near such a product to detect a sudden or unexpected rise in temperature. Similarly, certain goods may emit a certain chemical if the product decomposes. Accordingly, a sensor which detects that chemical may be used to detect and report the production of the chemical. A sensor which detects the presence of the chemical being shipped might be utilized near the shipping container to detect and report any leaks.

The manufacturer's knowledge of the goods being shipped and of what hazardous or undesirable conditions may develop during shipping may be used to select the conditions most important to monitor, and those sensors which are suited to detect the relevant conditions.

The above method of monitoring goods in transit for conditions which are dangerous or damaging to the goods is advantageous because it provides a manufacturer greater ability to ensure safe shipment of the goods. Because of the dangers involved with transporting chemicals or dangerous goods, there are often significant restrictions on how those goods may be transported, or how strictly the goods must be monitored and controlled during transport. By utilizing a monitoring and control device in combination with specifically selected sensors and monitoring devices, a manufacturer may more easily and cost effectively comply with the shipping regulations. Additionally, as additional emphasis is placed on shipping dangerous goods and national security, shipping requirements might become even more strict than at present. The present invention gives manufacturers and shippers of goods the ability to monitor and control many various aspects of shipment to ensure a safe shipment and comply with applicable regulations. Furthermore, the information could be used to more quickly notify authorities of safety threats, i.e. a stolen truck of potentially explosive materials, and to track location of the goods.

Accordingly, the present invention provides significant advantages in shipping goods. Through the present invention, companies are able to ensure the proper shipment of goods, including a variety of shipping parameters such as the shipping conditions, the shipping route. Additionally, the company is able to maintain real time knowledge of the shipment, allowing the company to track, monitor, and manage the shipment.

Figure 3:
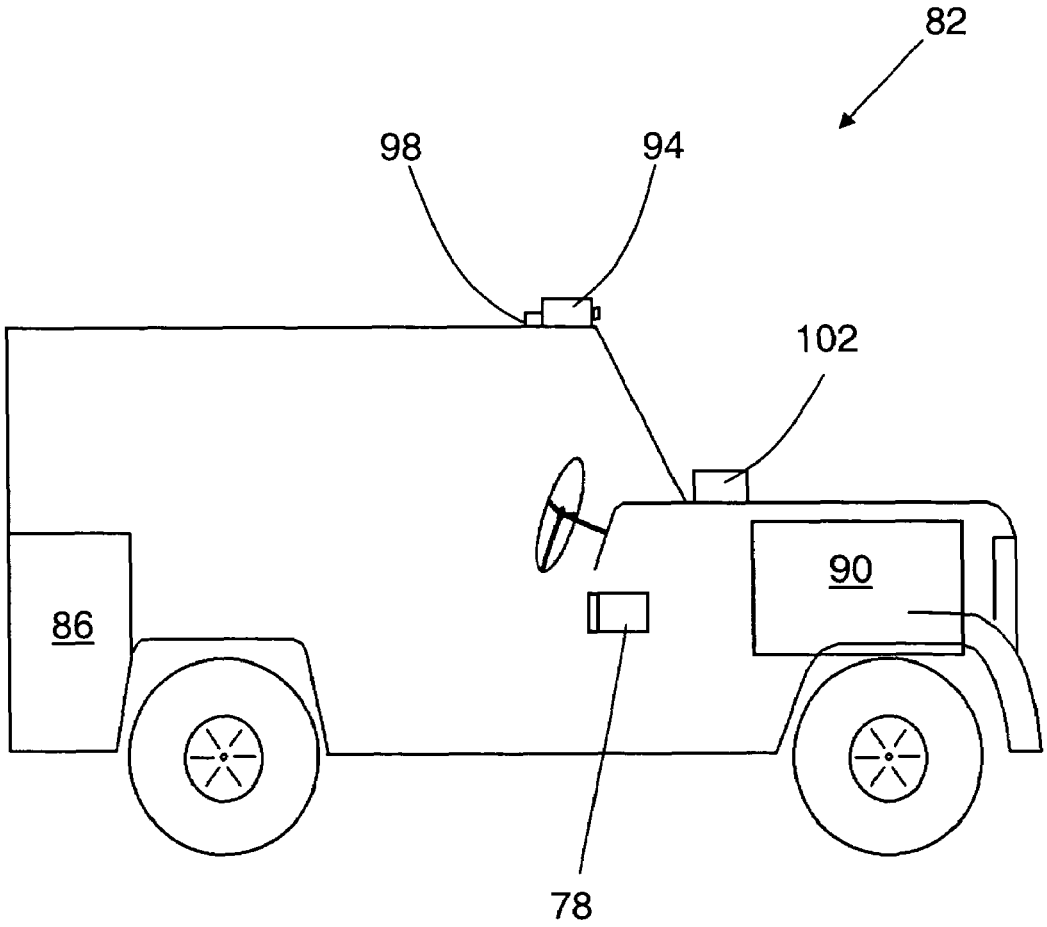
FIG. 3 shows a vehicle having a monitoring and control device.

Turning now to FIG. 3, a vehicle is shown with a monitoring and control device according to the present invention. The monitoring and control device 78 may be used to monitor many parameters of a vehicle, indicated generally at 82. The monitoring and control device may be used to monitor the fuel tank 86, the engine 90, and the position and movement of the vehicle. The device 78 may also be connected to a camera 94, a microphone 98, and external sensors 102 to monitor the conditions external to the vehicle 82.

By way of example, it is often desirable to remotely monitor fuel or fluid qualities of various vehicles. The Army may desire to monitor the fuel levels of vehicles which have been sent out on assignments. By monitoring the fuel level, the command unit may have real time data regarding the vehicle's travel capacity. Additionally, a GPS unit may be incorporated into the monitoring and control device. The command unit may thus maintain real time information regarding the location and movement of a vehicle, as well as the distances the vehicle could travel. The command unit may thus make decisions regarding the vehicle assignment and redirect the vehicle or change the assignment.

The monitoring and control device also may be equipped with any of a variety of sensors as is desired. The device may be used to monitor the engine status of the vehicle if desired. The monitoring and control device may also be used to monitor the surroundings. The device may be connected to a video camera, microphone, or sensors used to monitor the environment or exposure to potentially harmful chemicals etc. The monitoring device may thus provide a real time display of the progress of the vehicle and crew in carrying out the assignment, and indicate the conditions in which the vehicle is found.

The use of a monitoring and control device in a vehicle allows a control center to maintain real time information about the vehicle and manage the vehicle course, destination, objectives, etc. as is needed. The monitoring and control device also allows the control center to monitor a large number of vehicle and environmental conditions to track the progress of the vehicle as well as monitor for problems, allowing the control center to customize the assignment which the vehicle is to fulfill.

Accordingly, the monitoring and control device may be used in land vehicles, ships, airplanes, and even unmanned vehicles. The monitoring and control device allows a fleet manager to monitor the vehicles and to document cases of misuse, theft, etc.

Figure 4:
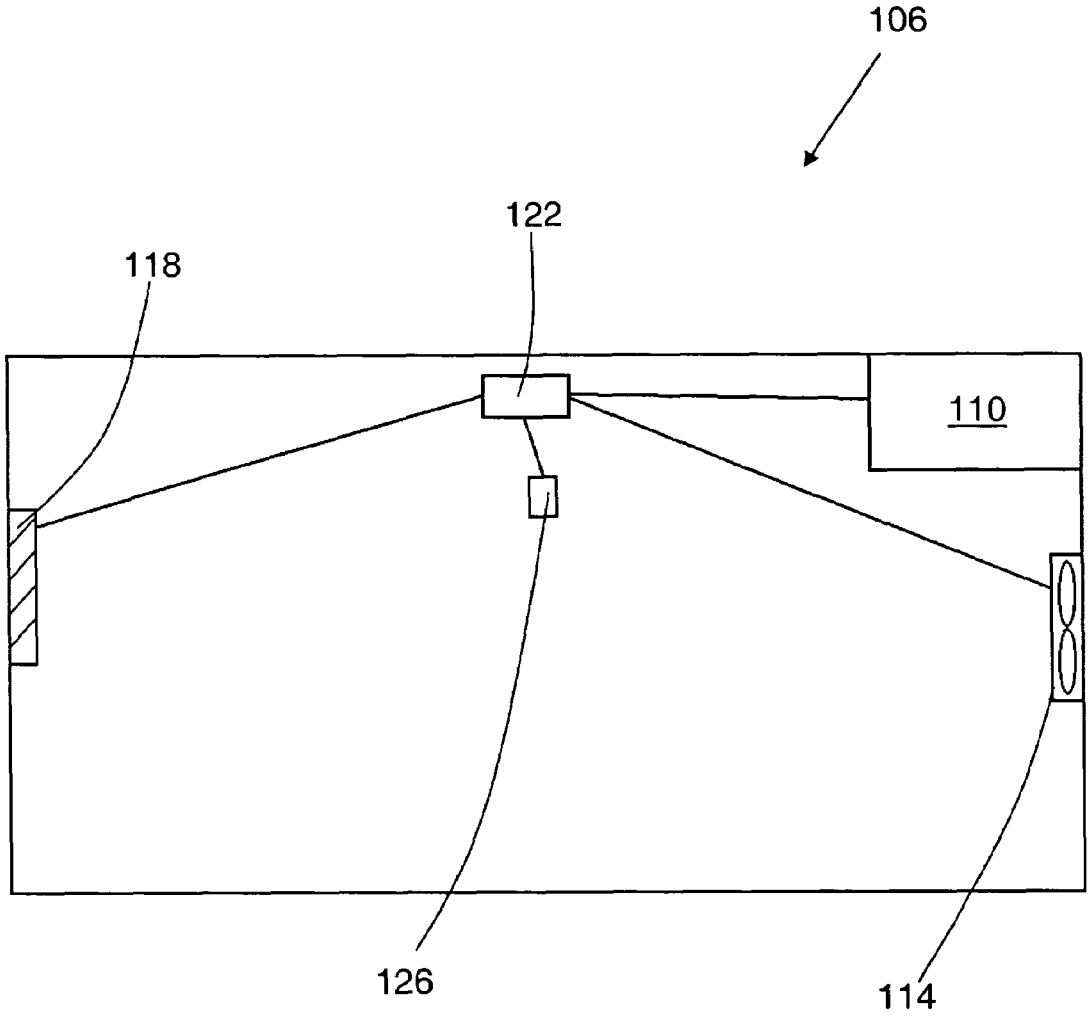
FIG. 4 shows a shipping container with a monitoring and control device.

Turning now to FIG. 4, a shipping container with a monitoring and control device according to the present invention is shown. The shipping container, indicated generally at 106, may contain equipment such as a refrigeration and/or heating unit 110, a ventilation fan 114, or a vent 118 to regulate the conditions within the container. The monitoring and control device 122 will typically be connected to the refrigeration unit 110, fan 114, or vent 118 if they are present in the container.

Additionally, the monitoring and control device 122 may be connected to additional sensors 126 as is desired for the particular requirements of the shipment. The sensors 126 may include a temperature sensor, an oxygen sensor, a carbon dioxide sensor, a light sensor, etc. The monitoring and control device 122 thus allows a person at a control facility to check and regulate conditions inside of the container 106.

The present invention may thus be used advantageously in applications such as the shipping of bananas, where the ripening process is controlled during shipping. Typically, bananas are loaded onto a cargo ship soon after harvesting. The bananas are cooled before loading into the storage container to slow the ripening process, and the conditions during shipment are then controlled to regulate the ripening of the banana.

The ripening of the banana is affected by a number of parameters, such as the temperature and humidity of the air in which they are stored, and by the presence of certain gasses such as carbon dioxide and ethylene, which are produced by the ripening banana. The ripeness of the banana can be controlled by controlling the temperature of the storage container, and by controlling the airflow to regulate the amount of carbon dioxide and ethylene present in the container. The relative degree of ripeness can also be determined by measuring the concentration of the gasses produced by the banana and found in the air inside the storage container.

Typically, the conditions for shipping the bananas are regulated to minimize the ripening of the bananas during shipment in the cargo boat. Once the bananas arrive in port, they are typically inspected. Because the containers of bananas are constantly adjusted by workers during shipping, they must be inspected upon arrival, which delays the fruit. The bananas are then shipped in a refrigerated truck to a ripening facility, where the bananas are placed in a ripening room. The temperature and humidity are carefully controlled during ripening, and ethylene is typically added to the air in the ripening room to promote the ripening of the bananas.

The ripening usually takes from four to eight days. Typically, the ripening time is adjusted according to the needs of the banana purchasers. The bananas can be maintained in a slightly elevated temperature and concentration of ethylene to accelerate the ripening process. Once the bananas are ripened sufficiently (typically half as ripe as the consumer desires before eating the banana) they are shipped to stores and or distribution centers in refrigerated trucks for further distribution and sale.

The current method of shipping bananas requires that a significant number of crew members on the cargo boat monitor and adjust the conditions of shipment. Additionally, the current method requires that the bananas be stored in an additional storage facility and ripened after arriving. Thus, the current method of importing and ripening bananas presents additional delays and expenses which can be eliminated.

A monitoring device may be used to remotely monitor and control the ripening of the bananas while in transit on the cargo ship. The monitoring device will be configured with the necessary components to accomplish the task, which may include a temperature sensor, one or more carbon dioxide sensors, an air flow sensor, an optical sensor, or other necessary sensors, in combination with a processing unit, output control units, possibly a GPS unit, and a communications unit capable of communicating to a central control facility responsible for the shipment of bananas.

According to the present invention, each of the individual truckload sized storage containers on the ship is outfitted with a monitoring device. The monitoring device operates on several levels. First, it can sense the temperature and other relevant conditions inside the container, such as the carbon dioxide level, and adjust the refrigeration unit or airflow fans to maintain the conditions within an acceptable range for shipping the bananas. This first level of control over the shipment is advantageous because it eliminates the need for a number of workers currently used to inspect and adjust the shipping conditions through transit.

More importantly, however, the monitoring devices installed on the containers may be used to more accurately ripen the bananas, eliminating the need for a separate storage and ripening facility once the bananas arrive. The monitoring devices can measure the level of ripeness in a variety of ways. A simple method of measuring the ripeness may be installing a carbon dioxide sensor in the container to measure the amount of carbon dioxide present, indicating how ripe the bananas are. Another method might involve measuring the amount of carbon dioxide in the effluent air from the container, the amount in the inlet air, and the airflow to determine the rate of production of carbon dioxide and determine the ripeness of the banana. Another method of determining the ripeness of the banana might include taking a picture of the banana with a small digital camera connected to the monitoring device to determine the color of the banana, as the relative amounts of yellow and green banana skin are commonly used as an indicator of ripeness.

According to the level of ripeness measured, the conditions in the container can be modified to increase or decrease the rate of ripening of the bananas. An individual in the control facility responsible for the shipment of bananas can adjust the ripening of the bananas to suit the needs of the various banana purchasers. By knowing the time of transit in the cargo ship (possibly provided with the GPS unit, or more simply from communication from the ship itself or expected travel time), the desired level of ripeness, and the conditions necessary to ripen the bananas to the desired level, the control facility can ripen the bananas to the proper level during the shipment.

The output control devices of the monitoring device can be used to adjust the necessary storage and shipping conditions, such as air flow and temperature remotely and accurately. This eliminates the need for an additional storage facility, and also eliminates the additional time and expense in transporting the bananas to the facility and the delay in selling the bananas. Additionally, each individual container of bananas in the cargo ship can be ripened to a different level, according to the needs of the various purchasers. Local purchasers who need the bananas for quick sale can have bananas which arrive riper than those for a purchaser who must first ship the bananas to a location farther away. Accordingly, the monitoring and control systems according to the present invention can ripen the bananas as desired such that they are or will be ripe on a specific day. Accordingly, by using remote monitoring devices, significant time and money can be saved in transporting and ripening bananas prior to sale to the various retailers and distributors.

Many similar situations exist where a product may be ripened or processed while in transport by managing the conditions of transport. For example, bread dough may be maintained in an appropriate condition during transit such that it is ready or substantially ready for use upon arrival, without requiring significant additional steps, such as thawing. Many types of fruits or vegetables may be conditioned during transit such that they are ready for use upon arrival. Additionally, many products must be maintained within certain conditions for a period of time after manufacture so that the product may cure properly. The ability to precisely control the conditions in a shipping truck or container with a monitoring and control device allow a manufacture to complete a cure period while the item is in transit instead of maintaining a separate warehouse for storing the items while curing.

Figure 5:
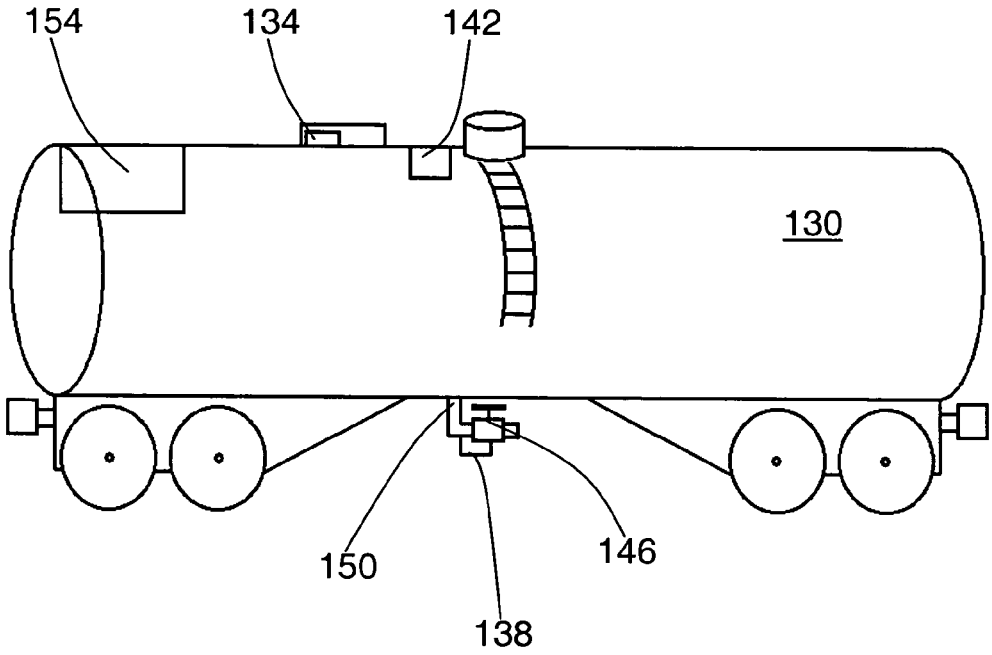
FIG. 5 shows a rail car with a monitoring and control device.

Turning now to FIG. 5, a rail car is shown with a monitoring and control device according to the present invention. The rail car 130 may be equipped with a monitoring and control device 134, and may typically be equipped with additional sensors 138, 142.

The monitoring and control device 134 may be mounted in a convenient location on the tank car 130 which protects it from the elements and from tampering. The sensors will be chosen according to the needs of the goods being shipped. For example, sensors 142 may be placed on or inside of the tank, and may include temperature, pressure, chemical sensors, or the like as may be desired to monitor the chemicals which are being shipped. Sensors 138 may be used to monitor the valves 146 and drain pipes 150 of the tank car 130 to ensure that the valve 146 is not opened accidentally or without authorization. The sensor 138 may also include a flow sensor or fluid sensor to determine if and or how much of a fluid has leaked from the tank.

The monitoring and control device may also interface with any other equipment 154 which is used to operate the tank car. This equipment may include a refrigeration unit, heater, or other equipment. The monitoring and control device may be used to remotely adjust the equipment and ensure that the proper shipping conditions exist. It will also be appreciated that a monitoring and control device according to the principles discussed may also be similarly used in other rail cars, such as refrigerated box cars or the like.

An example application for the present invention is in shipping chemicals in railroad tank cars. Typically, a chemical manufacturer, for example, will produce a large quantity of a chemical. The quantity of the chemical produced is largely dependent on the amount of that chemical typically sold. The chemical is then stored in one or more large storage tanks, often near the manufacturing facility. In the storage tank, the chemical can be maintained under the proper conditions until a customer orders a quantity of the chemical. Once ordered, the manufacturer will load the quantity of the chemical onto a number of railroad tank cars for shipment to the customer. The chemical than takes a number of days to arrive at the customer's place of business.

The manufacturer typically has a large number of tank cars available, as a sufficient number must be always available to meet the orders without significant delay. Most of these tank cars remain empty and await orders to be placed.

According to the present invention, the manufacturer can eliminate the storage tanks and facility and load the chemical onto railroad tank cars as it is produced. Ordinarily, various limitations prevent the manufacturer from doing so, including the need to control and/or document the conditions under which the chemical is stored, and for many dangerous chemicals, statutory requirements to carefully monitor the chemical at all times. Limitations on shipping hazardous chemicals may require the manufacturer to know where the chemicals are at all times, and to know immediately if the chemical tank car is tampered with or if some chemical is removed from the tank.

The present invention allows the manufacturer to do so. A control and monitoring device may be placed on the tank to allow the manufacturer to measure and track tank conditions important to the shipment and storage of the chemical. For example, the device may utilize a sensor to monitor the temperature or pressure of a chemical to prevent it from rising past a critical level. The monitoring device may also be used to determine if the tank car has been tampered with, by detecting flow from the tank, opening an access door, or opening a valve, for example.

The monitoring device relays this information back to a control center and notifies the manufacturer of any condition or occurrence at the tank car. An individual at the control center can, if desired, send signals back to the monitoring device and make desirable adjustments at the tank car through electronic output signals, control servos or motors, or the like.

The ability of the manufacturer to adequately monitor and control the tank cars provides the freedom to store the chemicals in the tank car instead of a storage tank at a storage facility. This saves cost by eliminating the storage facility. A manufacturer will typically have a large number of tank cars available to assure an adequate number of available cars to cover potential orders. These cars typically remain empty awaiting orders, at which time they are filled and sent to customers. The manufacturer may simply fill the tank cars with the chemical as it is produced, eliminating the storage facility. No additional cars are needed, as the manufacturer has sufficient cars to cover the potential orders.

A manufacturer can send the filled tank cars to various locations near customers to await delivery to the customer. The manufacturer may determine what is the proper number of tank cars to deliver to various locations based on the past order history and the projected needs of the customers. If a customer typically uses 10 tank cars of a chemical every month, and it has been a few weeks since the last delivery to the customer, the manufacturer will fill 10 tank cars with the chemical and move the tank cars towards the customer.

The tank cars may be stored on a rail spur near the customer's business. In industrial cities, a large number of rail spurs are available in the rail yards to accommodate the large number of rail cars entering and exiting the rail yard. Because the tank cars are being stored on a rail spur near the customer's business at expected shipment dates, the cars may be quickly delivered to the customer. Where an order may take a week or more to fill using the conventional storage facilities and supply methods, an order may now be delivered to a customer hours after placing the order.

Delivering shipments of chemicals to a customer according to the preceding method benefits the manufacturer because the manufacturer saves the costs typically associated with storing the chemicals in a large storage tank, and because providing a quicker service makes the manufacturer more desirable as a supplier to existing and additional customers. The delivery method benefits customers by drastically reducing the time required to deliver goods once ordered.

According to the above and other aspects of the present invention, the monitoring and control device provides a variety of additional safety, quality, and control features in shipping. For example, sensors may be place on a shipment to monitor valves or doors.

Where a liquid or gas is shipped in a storage container, such as on a rail car, sensors may be placed on the container valves. The sensors are capable of determining if a valve is open or tampered with. Where a valve has a crank handle to open the valve, the sensor could be configured to sense the rotation of the crank. Additionally, a flow sensor could be used to detect any loss of the container contents through the valve.

Similarly, movement sensors may be installed on doors of a shipping container or shipping trailer, etc. to monitor for opening of the door. Any sensors installed to monitor the shipment will be connected to the monitoring and control device, and the monitoring and control device will send relevant information to a control facility where the shipment is monitored. Door sensors will enable the monitoring of any relevant doors associated with the shipment. It can thus be known if a door has been tampered with. Additionally, it is possible to monitor whether the doors are open or closed and correct a problem before it damages the goods being shipped. The door sensors may also work in combination with other devices, such as cameras, to record the image of a person who opens the door.

Additionally, it may be necessary to monitor rail cars which contain hazardous materials. It may be desirable to monitor the chemical level, changes in the amount of the chemical, the opening of valves, flow out of the rail car, etc. According to the above mentioned monitoring and control device, the car may be adequately monitored as required. Additionally, the monitoring system may be used to provide necessary information in the occurrence of a leak or other emergency event. The railroad, shipper of chemicals, or the first to respond to the event may be provided with OSHA, or EPA information, or other information such as the material safety data sheet for the chemical which is being shipped. The person may be provided with a number on the rail car to call to receive this information, or the information may be sent automatically to previously designated individuals. Thus, the monitoring and control device may be used to more safely ship chemicals, to comply with government requirements in shipping various chemicals, and to improve safety and cleanup in the event of an accident.

Figure 6:
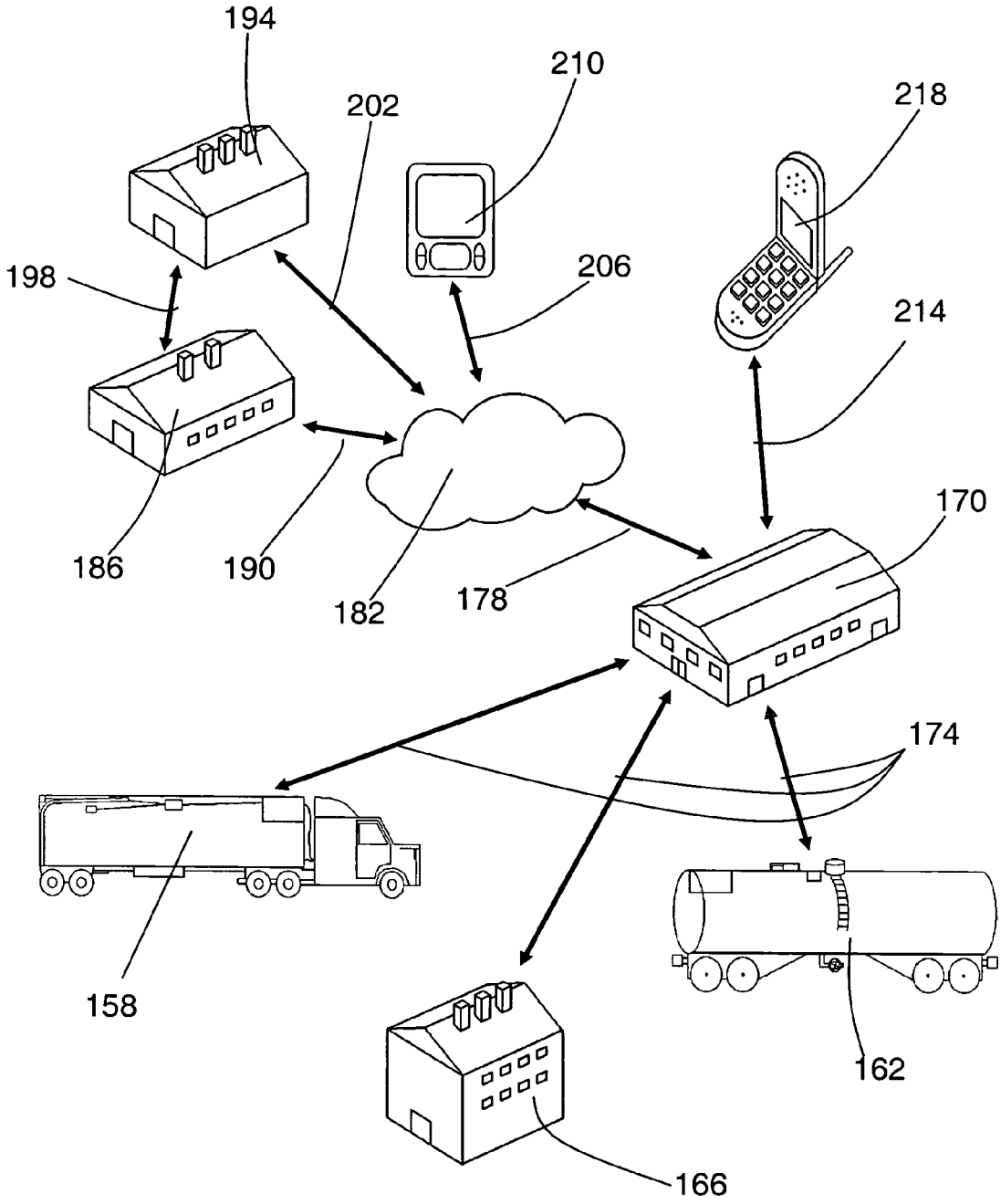
FIG. 6 shows a diagram of a possible communications network according to the present invention.

Turning now to FIG. 6, a diagram showing the communication between various monitoring and control devices and various end users is shown. A number of different uses for a monitoring and control device, such as a semi-truck 158, a rail car 162, or a building 166 such as a factory, shop, etc. Each of the monitoring and control devices communicates with a central control facility 170, indicated by arrows 174. Communication between the various monitoring and control devices and the control facility 170 involves the devices both sending and receiving information from the facility. Accordingly, the central control facility 170 is able to control the operation of the monitoring and control devices, and the equipment to which they are connected. The communication between the control facility 170 and the individual monitoring and control devices may be through satellites, the cellular network, local and wide area networks, etc. as is best suited to each individual application.

A significant function of the central control facility 170 is to provide a communications link between the monitoring and control devices and the end user of the device, which may be a manufacturer, shipper, customer, or other group. The control facility 170 will contain various computer systems (not shown) responsible for communication with the monitoring and control devices. Accordingly, access to the computer systems (indicated by arrow 178) may be provided via the internet 182. Individual end users may use the internet to log into individual accounts on the control facility computer systems to manage their monitoring and control devices.

A company 186, such as a manufacturer or shipping company, may thus communicate 190 with the control facility 170 to manage assets which are associated with a monitoring and control device. Additionally, the company 186 may allow a customer 194 to control those goods which have been sold to the customer, either by logging in to an account on the company's computer system 198, or by directly logging in to a separate account on the control facility's computer system 202.

In addition to communication between computer systems, it is possible for the control facility 170 to send communication 206 to a portable device 210 such as a hand held organizer. Such communication may be sent as an email or text message, and responding to the message or sending a separate message may control a specific monitoring and control device. Additionally, the control facility 170 may communicate 214 with a cellular phone 218. The control facility 170 equipment may be configured to automatically send voice messages to predetermined telephone numbers, and may allow a person to call the control facility 170 to control a specific monitoring and control device, either through a human assistant, an automated voice message system, or the like.

Accordingly, various aspects of the present invention allow a company to maintain control over a shipment or various items to ensure proper management of the goods. According to another aspect, the customer who has purchased goods may be allowed to control certain parameters of the shipment or management of the items through the monitoring and control device. A customer may be allowed to access the control device through an internet site or the like which is linked into the control facility either directly or through the company computer system and through which the customer may make changes to specified shipping or item management parameters. Additionally, the customer may be able to monitor and track the shipment. It will be appreciated that the customer may be allocated as much or little control over the shipment or items as is appropriate.

Figure 7:
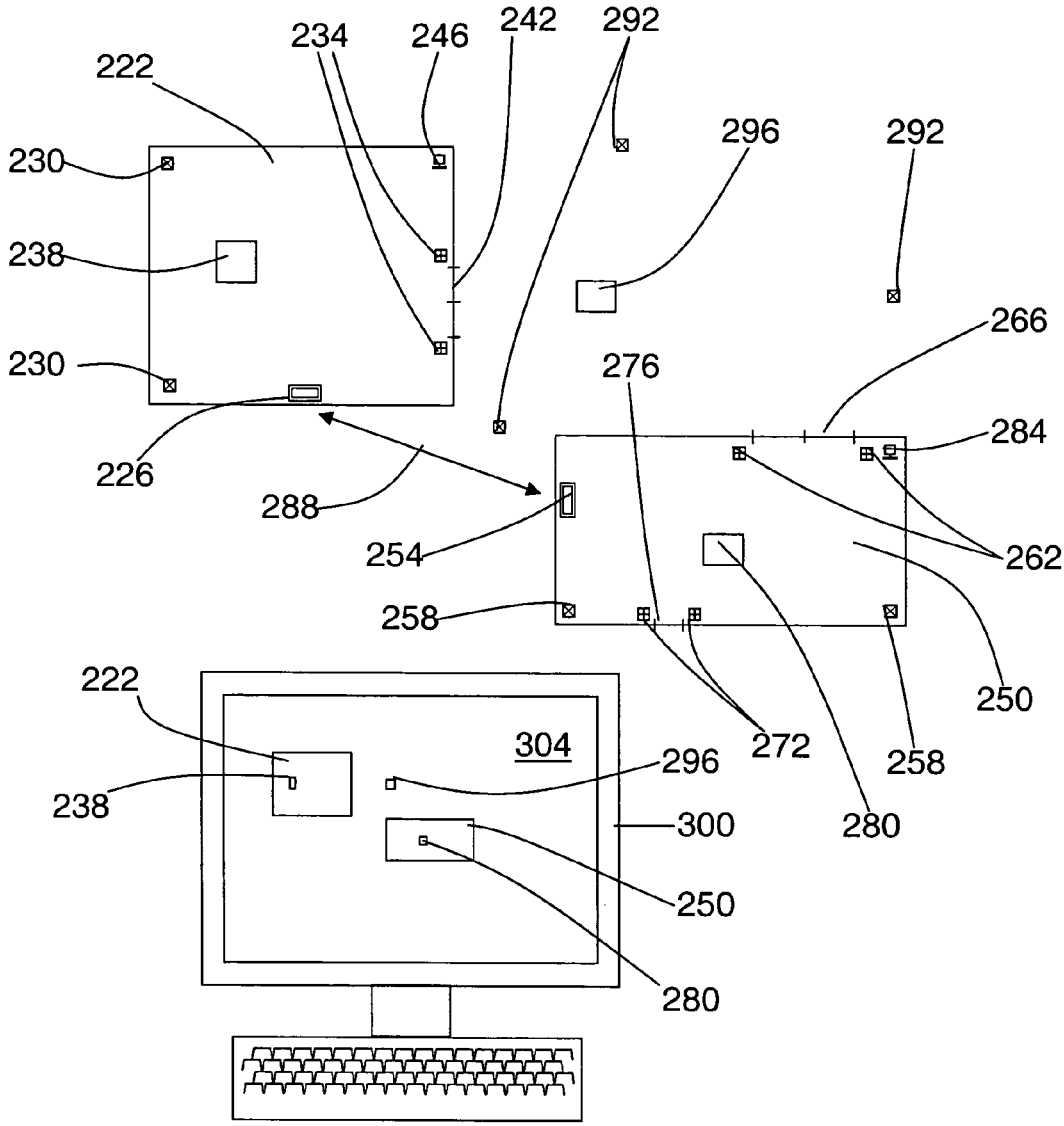
FIG. 7 shows a monitoring system according to the present invention.

Turning now to FIG. 7, a diagram of a wireless control network associated with particular buildings is shown. A first building 222 may utilize a monitoring and control device 226 in combination with sensors 230 and door sensors 234 to create a wireless network within the building which is capable of detecting the location of particular items 238 within the building 222. The sensors send signals, such as radio signals, which are received by identifying tags (e.g. RFID tags) which send the signal back to the sensor. The RFID tags may each have a identifying characteristic such that the sensors can distinguish the signals received from different tags, and associate each signal with a particular tag, and thus a particular item. The use of multiple sensors allows the system to triangulate the location of the item.

The door sensors 234 are placed in proximity to the door 242, and determine if a particular item has moved through the door. A computer 246 is used to track the location of the tagged items 238 within the building 222.

Additionally, the monitoring system of the first building 222 may be connected to a similar monitoring system installed in a second building 250. The second monitoring system is similar to the first monitoring system, and utilizes a monitoring and control device 254, sensors 258, and door sensors 262, which are mounted near the door 266. Additionally, the system for any particular building may contain additional sensors to monitor desired areas, such as door sensors 272 which are mounted near a back door 276.

The monitoring system of the second building 250 is able to determine the location of items 280 within the building, and may typically contain a computer 284 to track and or display the location of the item 280.

The monitoring and control devices 226, 254 may be in communication, shown by arrow 288, so that the two buildings 222, 250 are connected to form a single monitoring system, such that a person may track and view the location of items inside of either building. Accordingly, as many buildings as is desired may be connected together. In addition to buildings, the system may use external sensors 292 to track a tagged item 296 in a desired external area.

A computer 300 which is connected to the monitoring systems, such as computers 246 and 284, may be configured to display a map or drawing of the monitored area, indicated generally at 304, which, for the present example, would display the first building 222, the second building 250, and the individual items 238, 280, 296. The display is advantageous in that it graphically displays the location of each tagged item within the monitored area. Additionally, the computer may be programmed such that a person may select a particular item or type of items and display only the selected items on the screen, making it even easier to locate the items.

Additionally, many different items may be tagged for tracking and display. Even employee badges may be made with an identification tag so that the monitoring system can display the location of employees within the monitoring system.

A monitoring and control device according to aspects of the present invention is thus useful in tracking various items within a fixed location. Many companies or organizations, such as the Air Force, desire to track items such as tools, movable equipment, or high value parts within a building such as a warehouse. It is desirable to know where the item is, and record if the item leaves a designated area.

A monitoring and control device may be configured with a transmitter and receiver which are capable of communicating with simple and inexpensive tags, such as RFID tags. The monitoring device can thereby detect which tags are within its sensory range. The monitoring device may also be configured with a processing unit responsible for processing and transmitting signals from various parts of the device. Typically, the monitoring device may also be configured with a communications unit capable of transmitting and receiving information from a control facility.

In use, the monitoring and control device is able to sense and identify the tagged items within a desired location. The device remains in communication with a control facility to indicate the status of the tagged items.

It is also possible to use multiple monitoring and control devices within an area to triangulate the exact location of the tagged item. Accordingly, the monitoring and control devices may all be linked in to a computer system which can show the location of each item within the building. The computer may display a map of the premises with the location indicated on the map, or may display the information is another fashion. A system of this type facilitates easy tracking and locating of tagged items.

Additionally, the monitoring and control devices used may be connected to scanners placed on the entrances to the building, allowing the monitoring system to detect when a tagged item passes out of the building. The computer can thereby track which items are no longer present. The system may also function with one or more cameras placed near the entrances. The cameras will typically be connected to the monitoring and control devices such that the devices control the operation of the cameras. The system is thus capable of recording an image of any person who takes a tagged item through the entrance.

It may also be desirable to place a similar RFID type tag in employee badges, such that the monitoring system is capable of sensing the location of employees present in the area. Additionally, if used in combination with the entrance sensors, the system is capable of recording when an employee removes an item from the area and can identify the employee and item. It is further possible to establish multiple networks of monitoring devices in each building or area, allowing the system to monitor the location of an item across a larger area. The monitoring system may thus record and display where a tool, etc. is within a particular building, record when the tool left the building and which employee removed the tool, when the tool entered another building, and where the tool is within the new building.

The present invention is capable not only of establishing monitored and managed zones through use of a monitoring and control device, but is capable of interconnecting various different monitored and managed zones into a larger managed network. This ability provides greater ease and flexibility to an individual who is desirous of monitoring and managing various items.

The system is thus useful in preventing theft or loss, as well as identifying and locating valuable tools or items. Significant time can be saved where employees were previously required to manually inspect an entire warehouse or ship to find a necessary tool. The system as discussed allows the employee to simply check a computer to see exactly where the item is.

Various aspects of the above system are applicable in other situations, such as electronics stores. For example, a monitoring and control device may be used in combination with the door sensors and one or more cameras to record images of individuals stealing items from the facility.

According to other aspects of the present invention, a method of reducing theft is provided. It is not uncommon for theft to occur, especially where a shipping or storage container is accessible, such as with semi trailers. Theft may occur when an individual breaks the locks on the trailer and removes contents while the trailer is stopped, or even where the driver removes items from the trailer prior to delivery. The theft often remains undiscovered until the goods have been received by the customer and the customer discovers the missing goods. At this point, it is almost impossible to determine where the loss of goods occurred and who was at fault in losing the goods.

Accordingly, a monitoring device may be placed in a trailer or other shipping container, typically near the trailer door. The monitoring device may contain sensors, such as a radio frequency sensor, a movement sensor, or a camera, and may also contain output devices, such as a locking device. Additionally, the monitoring device will typically contain a battery power source, a processing unit, a GPS system, and a communications device.

In operation, the monitoring device will be in communication with a central control facility such that the monitoring device sends information to the control facility and receives commands from the control facility. For example, the monitoring device may be programmed to send the location of the trailer (as obtained from the GPS device) and other relevant information regarding the shipment to the control facility.

A radio frequency sensor may be used in combination with radio frequency identification tags (RFID tags) which are placed on the goods stored in the trailer. The sensor is able to sense the presence of the tags and determine which goods are on the trailer. The RFID tags can be encoded such that the sensor recognizes different types of tags, corresponding to different types of goods. Thus, the sensor can accurately determine what goods are on the trailer and communicate this information to the control facility. It will be appreciated that a number of different sensors and tags are available to provide the function described above.

If a person removes goods from the trailer, the radio frequency sensor immediately senses that the goods are no longer in the trailer, and can send this information to the control facility. In combination with the GPS device, the control facility can know when, where, and what goods were removed from the trailer. It can thus be determined if the goods were properly delivered to the customer before the loss occurred, indicating who is responsible for the loss.

The monitoring device can also be configured to work in combination with a camera. The camera can be configured to take a picture of the trailer door opening whenever the door is opened to thereby identify a person who is removing items from the trailer. This will provide important information in determining who is responsible for the theft. It can be determined, for example, if a driver is stealing items from the trailer.

A camera, or combination of cameras, can also be configured to perform other tasks, such as monitoring the contents of the trailer. The cameras can be made sensitive enough to still detect the contents of the trailer in the dark, and by using two cameras, it can be determined how full the trailer is and what different sizes and types of cartons are in the trailer.

Additionally, a device may be placed on the door of the trailer and used to determine if the door has been opened. The device may be set up so that it is not triggered unless the door is moved sufficiently far to be considered opened and eliminate false triggers caused by vibrations of the door. This device may be triggered to operate with a camera to take a picture of the person opening the door.

Additionally, the monitoring device may be designed with a locking mechanism. The locking mechanism can be configured to lock the trailer door from the inside, preventing an unauthorized person from opening the door. Additionally, the locking mechanism may be operated in response to a signal sent from the central control facility, such that the door can only be unlocked and opened after a signal is sent. This locking mechanism accordingly prevents unauthorized opening of the trailer.

The monitoring device will also typically contain a processing unit. The processing unit is responsible for accepting the signals from the sensors, processing the signals, and sending the information to the control facility via the communications device. Additionally, the processing unit is responsible for accepting information received from the control facility via the communications device and triggering a desired response in an output device or otherwise changing the operation of the monitoring device.

The communications device is responsible for communication with the control facility. Communication is available through a variety of means, including the control channel of the cellular network or satellite communications, depending on what is available in the area where the monitoring device is located.

The monitoring device will typically be powered from electricity received from the truck which is pulling the trailer, or for other types of transportation, power may be available from the engine, locomotive, etc. In the event that power is not available or that the power supply is interrupted, the monitoring device will typically contain a battery power supply. With the recent advances in battery technology, and modernized circuits and components which consume less power, it is not difficult to provide sufficient back-up power to operate the monitoring device for over a month on a relatively compact battery.

There is thus disclosed an improved monitoring and control device. The monitoring and control device according to the present invention is useful in a variety of situations. Although specific examples of the uses and benefits of a monitoring and control device have been discussed, it will be appreciated that many uses exist for a monitoring and control device, and the present invention is not limited to the applications discussed. The appended claims define the scope of the invention.

What is claimed is:

1. A method for shipping goods comprising:

disposing a monitoring device adjacent the goods, the monitoring device having at least one sensor for sensing at least one shipping condition of the goods and at least one output device for adjusting the shipping conditions of the goods, and the monitoring device being configured for communicating wirelessly with a remote location;

communicating information about the shipping conditions of the goods to the remote location; and adjusting the shipping conditions of the goods from the remote location via the at least one output device in light of the communicated information to control chemical properties of the goods.

2. The method of claim 1, wherein the method further comprises automatically adjusting the shipping conditions of the goods electronically in light of the communicated information.

3. The method of claim 1, wherein the goods comprise fruit and wherein the at least one shipping condition is selected from the group consisting of temperature, humidity, oxygen levels, carbon dioxide levels, ethylene levels, light, and fruit color, and wherein the method further comprises adjusting the shipping conditions of the fruit from a remote location to thereby control the ripening of the fruit.

4. The method of claim 3, wherein the method further comprises adjusting the ripeness of the fruit based on the final destination of the fruit.

5. The method of claim 3, wherein the method comprises shipping multiple containers of fruit, each container having a monitoring device, and ripening different containers to a different degree based on the final destination of the fruit.

6. The method of claim 1, wherein the at least one shipping condition is selected from the group consisting of the temperature of the goods, pressure of the goods, weight of the goods, volume of the goods, amount of goods, change in amount of goods, light in the container, oxygen in the container, carbon dioxide in the container, chemicals in the container, radiation emitted from the goods, and chemicals emitted from the goods.

7. The method of claim 1, wherein the method further comprises monitoring the contents of a rail car, transmitting information regarding the contents of the rail car to the remote location; and adjusting the storage conditions of the rail car contents according to information transmitted from the remote location to the monitoring device.

8. A method for shipping goods comprising:

disposing a monitoring device adjacent the goods, the monitoring device having at least one sensor for sensing at least one shipping condition of the goods and at least one output device for adjusting the shipping conditions of the goods, and the monitoring device being configured for communicating wirelessly with a remote location, the at least one shipping condition being selected from the group consisting of temperature, humidity, oxygen levels, carbon dioxide levels, ethylene levels, light, and fruit color;

communicating information about the shipping conditions of the goods to the remote location; and adjusting the shipping conditions of the goods from the remote location via the at least one output device in light of the communicated information and wherein the goods are fruit and the method comprises adjusting the shipping conditions of the fruit from a remote location via the at least one output device to thereby control the ripening of the fruit and adjust ripeness of the fruit based on the final destination of the fruit.

9. A method for shipping goods comprising:

disposing a monitoring device adjacent the goods, the monitoring device having at least one sensor for sensing at least one shipping condition of the goods and at least one output device for adjusting the shipping conditions of the goods, and the monitoring device being configured for communicating wirelessly with a remote location, the at least one shipping condition being selected from the group consisting of temperature, humidity, oxygen levels, carbon dioxide levels, ethylene levels, light, and fruit color;

communicating information about the shipping conditions of the goods to the remote location; and adjusting the shipping conditions of the goods from the remote location via the at least one output device in light of the communicated information further comprises adjusting the shipping conditions of the fruit from a remote location to thereby control the ripening of the fruit and wherein the method comprises shipping multiple containers of fruit, each container having a monitoring device, and ripening different containers to a different degree based on the final destination of the fruit.

10. A method for shipping goods comprising:

disposing a monitoring device adjacent the goods, the monitoring device having at least one sensor for sensing at least one shipping condition of the goods and at least one output device for adjusting the shipping conditions of the goods, and the monitoring device being configured for communicating wirelessly with a remote location so as to monitor one or more shipping condition selected from the group consisting of temperature, humidity, oxygen levels, carbon dioxide levels, ethylene levels, light, and fruit color;

communicating information about the shipping conditions of the goods to the remote location; and adjusting least one shipping condition selected from the group consisting of temperature, humidity, oxygen levels, carbon dioxide levels, ethylene levels, light, and fruit color to thereby control the condition of the goods while being shipped, wherein the goods are fruit and wherein the method comprises adjusting the shipping conditions of the fruit from a remote location to thereby control the ripening of the fruit.

11. The method of claim 10, wherein the method further comprises adjusting the ripeness of the fruit based on the final destination of the fruit.

* * * * *